US008998591B2

(12) United States Patent
Han de Man

(10) Patent No.: US 8,998,591 B2
(45) Date of Patent: Apr. 7, 2015

(54) PUMP DEVICE AND METHODS FOR MAKING THE SAME

(75) Inventor: Eelco Han de Man, Vlijmen (NL)

(73) Assignee: MeadWestvaco Calmar Netherlands BV, Richmond, VA (US)

( * ) Notice: Subject to any disclaimer, the term of this patent is extended or adjusted under 35 U.S.C. 154(b) by 265 days.

(21) Appl. No.: 13/258,561

(22) PCT Filed: Mar. 30, 2010

(86) PCT No.: PCT/US2010/029140

§ 371 (c)(1),
(2), (4) Date: Sep. 22, 2011

(87) PCT Pub. No.: WO2010/117754

PCT Pub. Date: Oct. 14, 2010

(65) Prior Publication Data

US 2012/0014824 A1 Jan. 19, 2012

Related U.S. Application Data

(60) Provisional application No. 61/164,755, filed on Mar. 30, 2009.

(51) Int. Cl.
*F04B 43/02* (2006.01)
*B05B 11/04* (2006.01)
(Continued)

(52) U.S. Cl.
CPC ..... *F04B 45/02* (2013.01); *A47K 5/1208* (2013.01); *B05B 11/0043* (2013.01); *B05B 11/0067* (2013.01); *B05B 11/007* (2013.01); *B05B 11/3018* (2013.01); *B05B 11/3032* (2013.01); *B05B 11/3033* (2013.01); *B05B 11/3035* (2013.01); *B05B 11/3064* (2013.01); *B05B 11/3036* (2013.01)

(58) Field of Classification Search
CPC ..... B05B 11/3035; B05B 11/3036; B05B 11/3064
USPC ..... 417/479, 374, 472; 222/107, 207, 209, 222/212, 213, 214, 215, 380, 495, 383.1, 222/630–633; 137/625.48, 625.49, 625.5
See application file for complete search history.

(56) References Cited

U.S. PATENT DOCUMENTS 2,943,417 A 7/1960 Greenspan
3,130,877 A 4/1964 Miller
(Continued)

FOREIGN PATENT DOCUMENTS

CH 680358A5 A5 8/1992
CN 2937092 Y 8/2007
(Continued)

OTHER PUBLICATIONS

International Search Report for PCT/US2010/029140 published as WO2010117754A3 on Oct. 14, 2010.
(Continued)

*Primary Examiner* — Devon Kramer
*Assistant Examiner* — Nathan Zollinger
(74) *Attorney, Agent, or Firm* — MeadWestvaco Intellectual Property Group

(57) ABSTRACT

Bellow actuated pump devices for dispensing a product from a container may include a bellow and a base or a bellow, a base, and a valve wherein actuation of the bellow dispenses a product and the de-actuation of the bellow refills the pump for the next actuation.

10 Claims, 9 Drawing Sheets

(51) Int. Cl.

| | |
|---|---|
| ***F04B 45/02*** | (2006.01) |
| ***A47K 5/12*** | (2006.01) |
| *B05B 11/00* | (2006.01) |

(56) References Cited

U.S. PATENT DOCUMENTS

| | | | | |
|---|---|---|---|---|
| 3,715,060 | A * | 2/1973 | Benson | 222/207 |
| 3,752,366 | A | 8/1973 | Lawrence, Jr. | |
| 3,987,938 | A | 10/1976 | Cooprider et al. | |
| 4,168,020 | A | 9/1979 | Benson | |
| 4,197,265 | A | 4/1980 | Burke | |
| 4,330,071 | A * | 5/1982 | Ohlson | 222/207 |
| 4,394,936 | A | 7/1983 | Shavit | |
| 4,830,284 | A | 5/1989 | Maerte | |
| 5,114,047 | A * | 5/1992 | Baron et al. | 222/129.1 |
| 5,238,153 | A | 8/1993 | Castillo et al. | |
| 5,518,147 | A | 5/1996 | Peterson et al. | |
| 5,524,795 | A | 6/1996 | Lee | |
| 5,860,567 | A | 1/1999 | Fuchs et al. | |
| 6,012,613 | A * | 1/2000 | Chen | 222/207 |
| 6,158,620 | A | 12/2000 | Polan | |
| 6,241,122 | B1 | 6/2001 | Araki et al. | |
| 6,419,117 | B1 | 7/2002 | Bosch | |
| 6,752,295 | B2 * | 6/2004 | Weber | 222/209 |
| 6,971,553 | B2 | 12/2005 | Brennan et al. | |
| 7,322,491 | B2 | 1/2008 | Py et al. | |
| 7,434,710 | B2 * | 10/2008 | Spriegel | 222/207 |
| 7,806,301 | B1 * | 10/2010 | Ciavarella et al. | 222/207 |
| 7,891,583 | B2 | 2/2011 | Sayers et al. | |
| 7,931,173 | B2 * | 4/2011 | Yuan | 222/207 |
| 2002/0074359 | A1 | 6/2002 | Weber | |
| 2006/0261098 | A1 | 11/2006 | Nilsson | |
| 2008/0029547 | A1 * | 2/2008 | Yuan | 222/207 |
| 2008/0116226 | A1 | 5/2008 | Py et al. | |
| 2008/0156829 | A1 | 7/2008 | Chen | |
| 2009/0183371 | A1 | 7/2009 | Mileti et al. | |
| 2009/0285510 | A1 | 11/2009 | Huang | |
| 2010/0012680 | A1 * | 1/2010 | Canfield et al. | 222/207 |
| 2010/0320226 | A1 | 12/2010 | Nilsson | |
| 2011/0031278 | A1 | 2/2011 | Han de Man | |
| 2013/0175301 | A1 | 7/2013 | Ray | |

FOREIGN PATENT DOCUMENTS

| | | | |
|---|---|---|---|
| DE | 29823309 | U1 | 8/1999 |
| DE | 102005012506 | A1 | 1/2007 |
| EP | 1886736 | A1 | 2/2008 |
| EP | 2251655 | A1 | 11/2010 |
| FR | 2127774 | A5 | 10/1972 |
| GB | 2150226A | A | 6/1985 |
| JP | 63161152 | U | 10/1988 |
| WO | WO9953388 | A1 | 10/1999 |
| WO | WO2010089501 | A1 | 8/2010 |
| WO | WO2010117754 | A2 | 10/2010 |
| WO | WO2011099309 | A1 | 8/2011 |

OTHER PUBLICATIONS

International Search Report for PCT/US2012/065527 published on Feb. 14, 2013.

International Search Report and Preliminary Report for PCT/US2011/057781 published on May 3, 2012.

European Search Report on EP11182255, published on Jan. 22, 2013.

* cited by examiner

PUMP DEVICE AND METHODS FOR MAKING THE SAME

CROSS-REFERENCE TO RELATED APPLICATIONS

This application is a national phase application of PCT Application PCT/US2010/029140, entitled "PUMP DEVICE AND METHODS FOR MAKING THE SAME," filed 30 Mar. 2010, and which claims the benefit of U.S. Provisional Application No. 61/164,755, entitled "PUMP DEVICE AND METHODS FOR MAKING THE SAME," filed 30 Mar. 2009, each of which are incorporated herein by reference in their entireties.

BACKGROUND OF THE INVENTION

1. Field of the Invention

Embodiments of the invention relate to pump devices and more particularly, to pump devices utilizing a bellow mechanism for operating a pump device.

2. State of the Art

The personal and beauty care markets utilize a wide variety of different pump mechanisms and devices for delivering fluid-based products to a user. The pump devices include traditional pumps using ball valves or flap valves. Unique pump devices are also being developed to increase aesthetic value of the pump device or to provide new or improved functionality to the pump device or overall product package.

Typically, pumps or pump devices are connected to a bottle or other container holding a product. The product may be a fluid or a fluid mixed with solids or gases. The pump is used to deliver the product from the container to a user. In some instances, the container is a bottle and in other instances, the container may be a bag, a pouch, or a tube. In any event, it is often desirable that the pump evacuate most of the product from the container.

While many different pump devices exist, the desire for new pump devices to improve aesthetics or functionality or to reduce costs associated with producing and assembling the pumps, exists. Therefore, it may be desirable to develop new pump devices having fewer parts which are capable of meeting the desired specifications and requirements for delivering particular products.

BRIEF SUMMARY OF THE INVENTION

According to certain embodiments of the invention, a pump may include a base having a container attachment, an inlet passage, an interior chamber partially defined by a spacer integral with or separated from the base, and a discharge passage. A bellow having a bellow dome, bellow walls, a bellow rim, and a bellow chamber defined by the shape of the bellow dome and bellow walls may rest on the base rim in a portion of the interior space. The combination of the bellow chamber and interior chamber may define a pump chamber. The bellow walls may seal against a portion of the base to close or otherwise valve the inlet passage and a portion of the bellow rim contacting the base rim may close or otherwise valve the discharge passage. Actuation of the bellow dome may disperse product from the pump and de-actuation of the bellow dome may draw product into the pump chamber.

According to other embodiments of the invention, a pump may include a base, a valve, a bellow, and a cap. The valve may be positioned within an interior chamber of the base and valve walls may contact a base spacer to seal a pump chamber defined by the bellow and an interior portion of the base. A portion of the valve may also contact a portion of the bellow. Actuation of the bellow may displace or break the contact between the valve and the bellow, allowing product in the pump chamber to flow out of a discharge passage in the base. De-actuation of the bellow may lift the valve and may break a seal between the valve walls and a portion of the base, allowing product to flow through an inlet passage in the base into the pump chamber.

According to still other embodiments of the invention, a pump may include a base having an interior space, a valve positioned in the interior space of the base and secured therein by an attachment adapter, and a bellow attached to a portion of the base wherein the interior space of the base and an interior chamber of the bellow define a pump chamber. Actuation of the bellow may move a portion of the valve, allowing product in the pump chamber to escape through a discharge passage in the base. De-actuation of the bellow may seal the discharge passage with a portion of the valve and allow product to flow past a second portion of the valve from a container and into the pump chamber.

BRIEF DESCRIPTION OF THE DRAWINGS

While the specification concludes with claims particularly pointing out and distinctly claiming particular embodiments of the present invention, various embodiments of the invention can be more readily understood and appreciated by one of ordinary skill in the art from the following descriptions of various embodiments of the invention when read in conjunction with the accompanying drawings in which:

DETAILED DESCRIPTION OF THE INVENTION

According to embodiments of the invention, a pump may include a base and a bellow. The base and bellow may be fitted together or otherwise positioned to create or define a pump chamber between at least a portion of the base and the bellow whereby the bellow may be actuated to fill the pump chamber with a product and expel product from the pump chamber. The base may be attached to or otherwise in communication with a product source, such as in communication with a container containing a product. Actuation and release of the bellow may pump a product from the container, through the pump chamber, and out of the pump, thereby delivering the product to a user.

According to other embodiments of the invention, a pump may include a base, a bellow, and a valve. The base may be in communication with a container containing a product and fitment of the bellow with the base and the valve may create or define a pump chamber between the base and bellow or the valve and bellow. Actuation and release of the bellow may pump a product from the container, through the valve into the pump chamber, and out of the pump, thereby delivering the product to a user.

Figure 1:
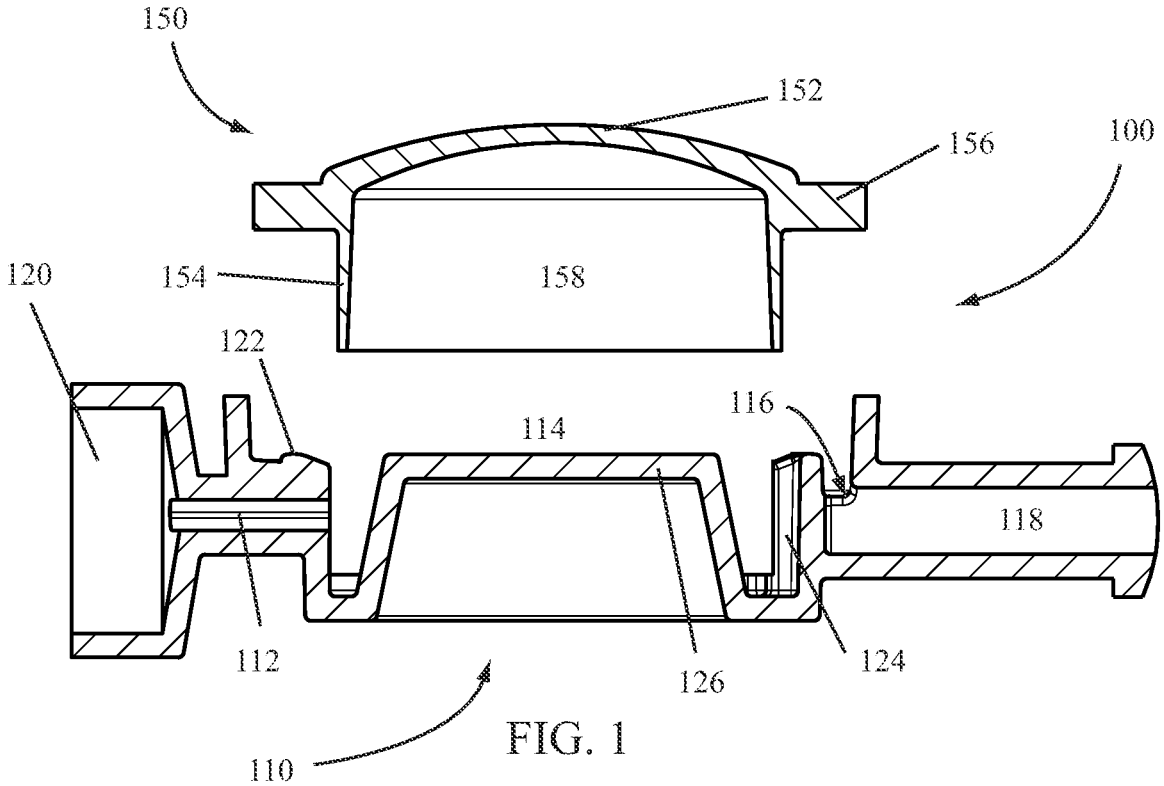
FIG. 1 illustrates a cross-sectional view of pump components for a pump according to various embodiments of the invention.

A pump 100 and components of a pump 100 according to various embodiments of the invention are illustrated in FIGS. 1 through 5. As illustrated in FIG. 1, a pump 100 may include a base 110 and a bellow 150.

The base 110 of a pump 100 according to various embodiments of the invention may include any one or more of an inlet passage 112, an interior chamber 114, an outlet 116, and a discharge passage 118. The base 110 may also include a container attachment 120. A base rim 122 may ring at least a portion of the interior chamber 114 of the base 110. Product passageways 124 may also be configured in a portion of the interior chamber 114 of the base 110. A spacer 126 formed in the base 110 may define the volume within the interior chamber 114 of the base 110. The base 110 may be constructed or made of any desirable material, and in some embodiments, the base 110 may be formed from a moldable plastic or resin material.

Figure 2:
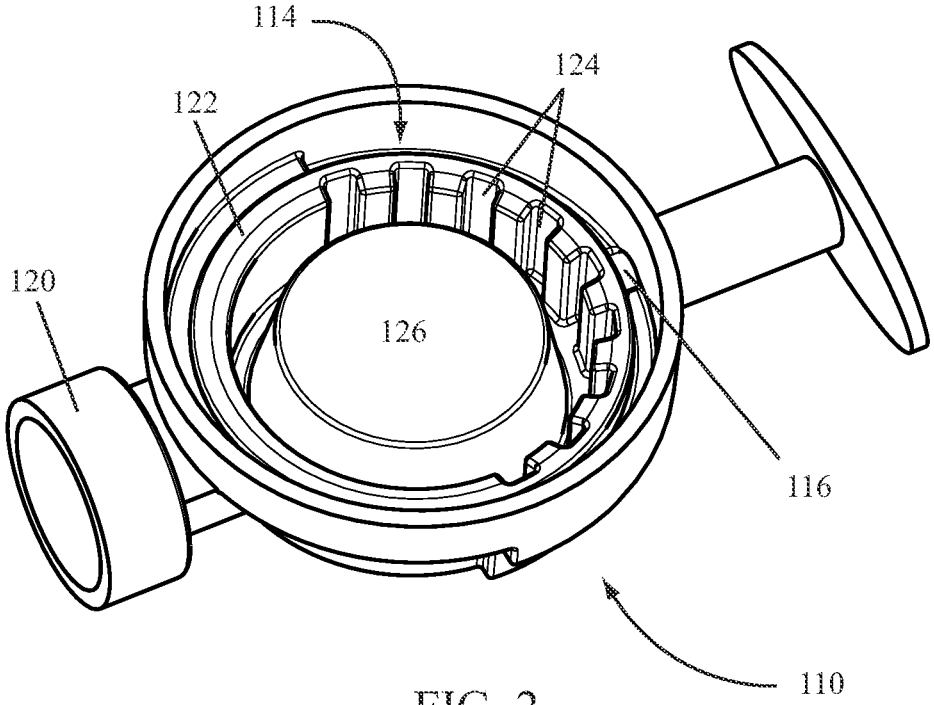
FIG. 2 illustrates a perspective view of a base of a pump according to various embodiments of the invention.

A perspective view of a base 110 of a pump 100 according to various embodiments of the invention is illustrated in FIG. 2. As illustrated, the container attachment 120 may be circular in shape. In other embodiments, the container attachment 120 may be configured or shaped as desired to communicate with a container or product source. An inlet passage 112 connects an interior portion of the container attachment 120 with the interior chamber 114 of the base 110. Product from a container may flow through the inlet passage 112 into the interior chamber 114. A spacer 126 formed in the base 110 may partially define the volume within the interior chamber 114 of the base 110. As desired, the spacer 126 may be configured or shaped to provide a desired volume within the interior chamber 114. A base rim 122 may encompass at least a portion of the interior chamber 114. One or more product passageways 124 may be formed in the interior chamber 114 of the base 110. An outlet 116 may provide communication between the interior chamber 114 of the base 110 and a discharge passage 118 of the base 110.

A bellow 150 according to various embodiments of the invention may include a bellow dome 152, bellow walls 154, one or more bellow rims 156 and an interior bellow chamber 158 as illustrated in FIG. 1. The bellow 150 may be shaped such that it may fit within a portion of the interior chamber 114 of the base 110. A bellow 150 according to various embodiments of the invention may be made from silicon, thermoplastic polyurethane (TPU), or other material as desired.

Figure 3:
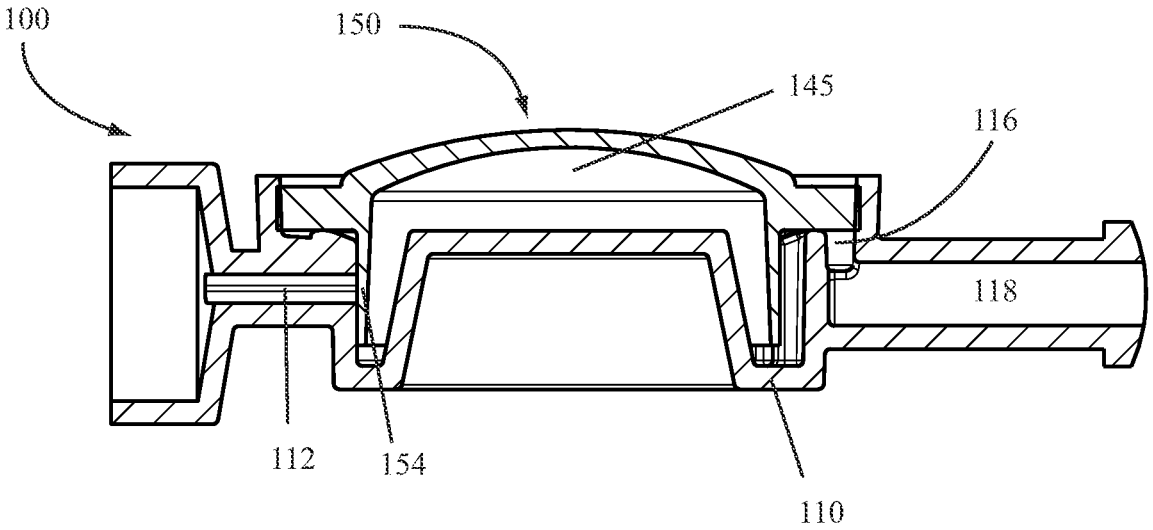
FIG. 3 illustrates a cross-sectional view of a pump according to embodiments of the invention.

FIG. 3 illustrates an assembled pump 100 according to various embodiments of the invention. As illustrated, a bellow 150 may be fitted with the base 110 to form a pump chamber 145 within the pump 100. The pump chamber 145 may be the combined space within the interior chamber 114 of the base 110 and the bellow chamber 158. As illustrated in FIG. 3, when the bellow 150 is fitted with the base 110, the bellow walls 154 may seal against an interior wall of the base 110 thereby closing off the inlet passage 112 from the pump chamber. The bellow 150 may also sit or rest within the base 110 such that the one or more bellow rims 156 are in contact with the base rim 122. The pump chamber 145 includes the space between the bellow chamber 158 and the interior chamber 114 of the base 110. In some embodiments of the invention, the bellow walls 154 do not reach a floor of the interior chamber 114 of the base 110, thereby leaving some room between the floor of the interior chamber 114 of the base 110 and the bottom of the bellow walls 154. In such instances, the pump chamber 145 may also include the space between an exterior of the bellow walls 154 and the one or more product passageways 124 in the base 110. The one or more product passageways 124 may provide a passage from the interior chamber 114 of the base 110 outside of the bellow walls 154 and up to a portion of the bellow rim 156 contacting the base rim 122. The interface or contact between the bellow rim 156 and a portion the base rim 122 may close the outlet 116 and isolate the pump chamber 145.

According to some embodiments of the invention, the base 110 may include a lip overhanging portion into which the bellow rim 156 may fit such that the lip overhanging portion is above the upper portion of the bellow rim 156 and may facilitate fitment of the bellow 150 with the base 110. In other embodiments of the invention, a cap may be secured to the base 110 with the bellow 150 between the cap and the base 110. Other methods for securing or fitting the bellow 150 and base 110 together may also be used as desired.

Figure 4:
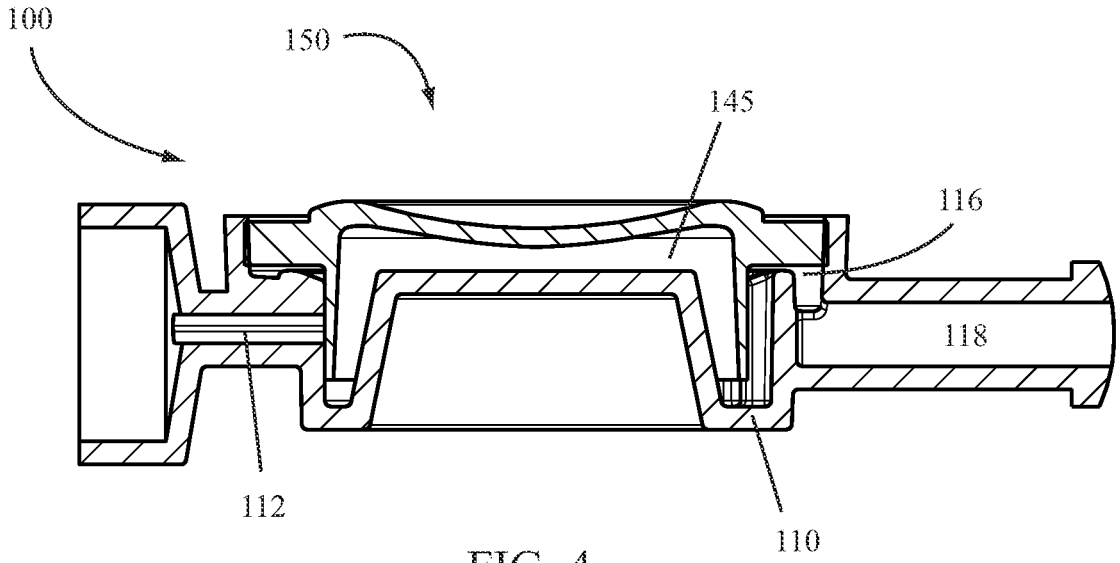
FIG. 4 illustrates a cross-sectional view of a pump according to embodiments of the invention.

A force applied to the bellow 150 may deform the bellow 150 as illustrated in FIG. 4. The deformation of the bellow 150, or application of a force to the bellow dome 152, applies a force to a fluid or gas contained within the pump chamber 145. The force applied to the fluid or gas in the pump chamber 145 may be sufficient to raise at least a portion of the one or more bellow rims 156. When the portion of the bellow rim 156 overlying the outlet 116 is raised or moved, fluid or gas from within the pump chamber 145 may flow through the outlet 116 and escape through the discharge passage 118.

When the force applied to the bellow 150 subsides or is released, pressure on the fluid or gas in the pump chamber 145 may be reduced and the bellow rim 156 may return to a position wherein the outlet 116 is again blocked. In addition, when the force on the bellow dome 152 is released, the bellow dome 152 may return to its original shape. The return of the bellow dome 152 to its original shape may draw a vacuum or create a reduced pressure within the pump chamber 145. The vacuum or reduced pressure may assist to pull the bellow rim 156 over the outlet 116 and to seal the outlet 116. In addition, the vacuum or reduced pressure may break the seal between the bellow walls 154 and the inlet passage 112, allowing fluid or product from a container to be pulled through the inlet passage 112 and into the pump chamber 145. In this manner, the pump chamber 145 may be primed or filled with a product which may then be evacuated by actuation of the bellow 150.

Figure 5:
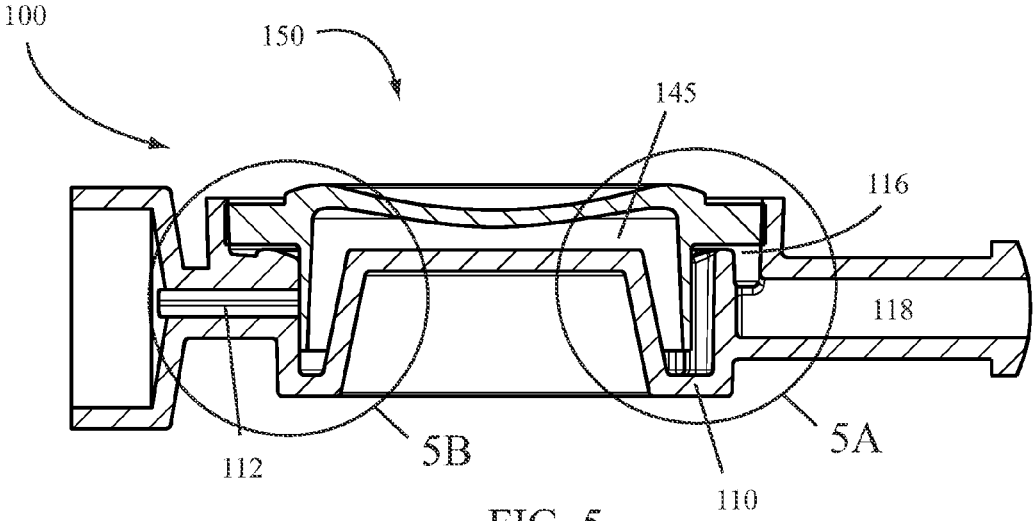
FIG. 5 illustrates a cross-sectional view of the pump of FIG. 4 showing detail portions.
Figure 5A:
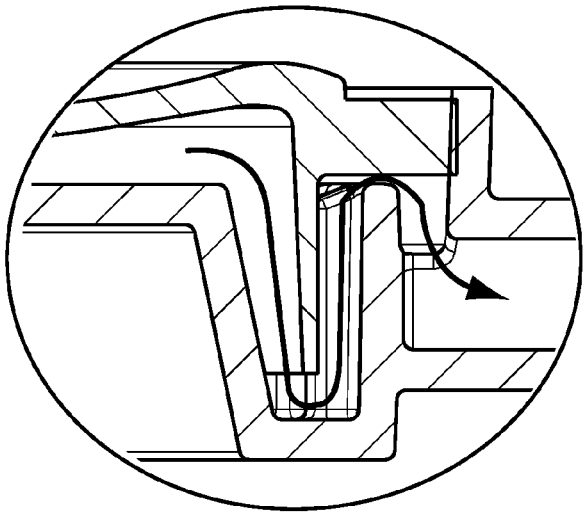
FIGS. 5A and 5B illustrates enlarged cross-sectional views of the pump illustrated in FIG. 5.
Figure 5B:
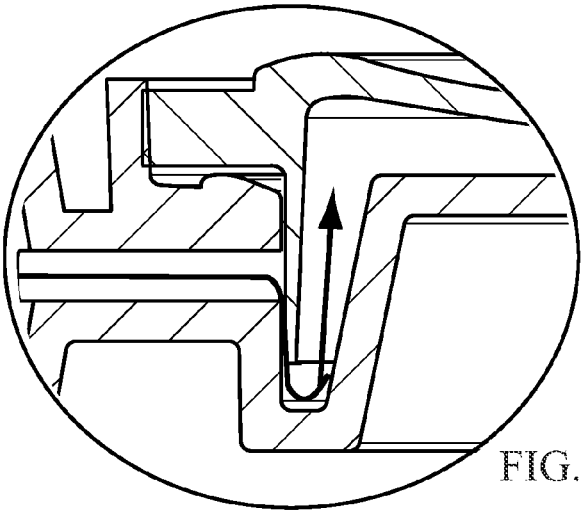

FIGS. 5, 5A and 5B illustrate a fluid flow path through a pump 100 according to various embodiments of the invention. As illustrated in FIG. 5, a force has been applied to the bellow dome 152, deforming the bellow dome 152 and applying a force to fluid or other product in the pump chamber 145. As force is applied to the bellow dome 152, product in the pump chamber is forced out of the pump chamber 145, through product passageways 124, through outlet 116, and out the discharge passage 118 as illustrated by the product flow arrow in FIG. 5A. When the force on the bellow dome 152 is released and the bellow dome 152 begins to return to its original shape, product flows through inlet passage 112, around bellow walls 154, and into the pump chamber 145 as illustrated by the product flow arrow in FIG. 5B.

Operation of a pump 100 as illustrated in FIGS. 1 through 5 may be accomplished by actuating bellow dome 152. Repeated actuation of the bellow dome 152 may prime the pump 100, draw product into the pump chamber 145, and allow a user to dispense the product through the pump 100 for any desired use.

According to other embodiments of the invention, a pump 200 may include various components as illustrated in FIGS. 6A through 6D.

Figure 6A:
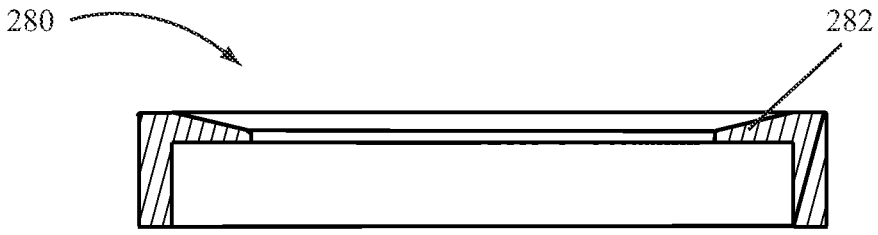
FIGS. 6A through 6D illustrate cross-sectional views of various components of a pump according to various embodiments of the invention.
Figure 6B:
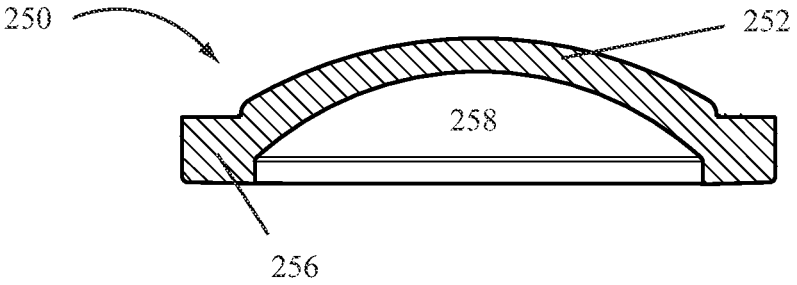
Figure 6C:
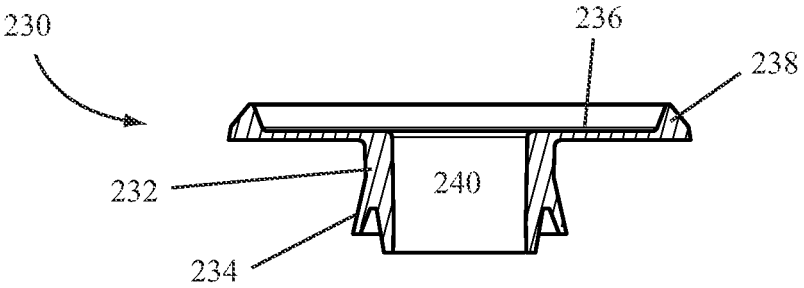
Figure 6D:
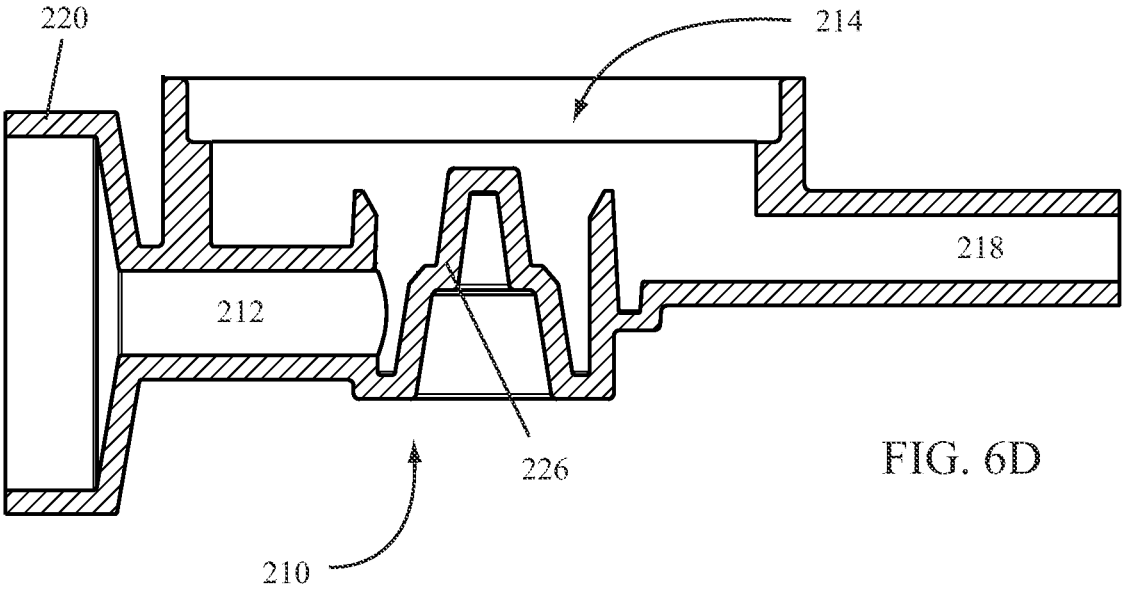

A base 210 of a pump 200 is illustrated in FIG. 6D. The base 210 may include a container attachment 220, an inlet passage 212, an interior chamber 214, a spacer 226, a base rim 222, and a discharge passage 218. The container attachment 220 may include any desired attachment device for attaching the base 210 or the pump 200 to a container such as a bottle, tube, bag, or pouch. The inlet passage 212 may allow a product to flow from a container into a portion of the interior chamber 214 of the base 210. The interior chamber 214 may include a volume which is partially defined by the spacer 226. The shape, size, dimensions and other specifications of the spacer 226 may be altered or modified to generate a desired volume, shape, or size within the interior chamber 214 of the base 210. One or more base rims 210 or other support structures for supporting other components of the pump 200 may also be included in the base 210. Product flowing through at least a portion of the interior chamber 214 may exit the base 210 through the discharge passage 218.

According to various embodiments of the invention, the base 210 may be molded as a single piece or component. In other embodiments, the base 210 may include two or more pieces or components. The base 210 may be molded or formed from any desirable material, including, for example, a resin material or a plastic material which may be molded using conventional molding techniques.

A valve 230 for a pump 200 according to various embodiments of the invention is illustrated in FIG. 6C. A valve 230 may include valve walls 232, a valve disc 236 in communication with the valve walls 232 and a valve rim 238 located on of the valve disc 236. One or more valve flanges 234 may extend outwards from the valve walls 232.

According to various embodiments of the invention, a valve 230 as illustrated in FIG. 6C may include valve walls 232 defining a valve chamber 240 or passage through the valve 230. A lower valve flange 234 may extend outwards from the valve walls 232. A valve disc 236 may circumscribe an upper portion of the valve 230 about the valve walls 232. An opening in the valve disc 236 may correspond with the valve walls 232 such that a passage through the valve 230 is defined by the valve walls 232 and the opening in the valve disc 236. A valve rim 238 may project upwards or away from the valve disc 236. As illustrated in FIG. 6, the valve rim 238 may circumscribe the entire valve disc 236. Although the valve rim 238 illustrated in FIG. 6C is located on an outer portion of the valve disc 236, it is understood that the valve rim 238 may located anywhere desired on the valve disc 236.

A bellow 250 according to embodiments of the invention is illustrated in FIG. 6B. A bellow 250 may include a bellow dome 252, a bellow chamber 258, and a bellow rim 256. The bellow chamber 258 may be defined by the shape of the bellow dome 252. Thus, different sizes and shapes of the bellow chamber 258 may be created by altering the shape or size of the bellow dome 252.

The bellow 250 may be formed of any desired material. In some embodiments of the invention, the bellow 250 may be a material that may be deformed but which will return to its original shape after a force causing such deformation is removed. For example, the bellow 250 may be made of silicon or a TPU material. The bellow dome 252 may be deformed to change the volume or shape of the bellow chamber 258. As the bellow dome 252 is deformed, the remainder of the bellow 250 may flex or deform in a corresponding manner as desired.

A cap 280 according to various embodiments of the invention is illustrated in FIG. 6A. A cap 280 may include a cap flange 282. According to various embodiments of the invention, a cap 280 may be attachable to the base 210 or to another portion of a pump 200 to keep the various components of a pump 200 assembled. For example, the cap 280 illustrated in FIG. 6A may be positioned over a bellow 250 and a base 210 to secure the bellow 250 in an appropriate position with respect to the base 210. A cap 280 according to various embodiments of the invention may include any desired means for securing the cap 280 to the base 210 or other portion of the pump 200. For instance, the cap 280 may be screwed onto the base 210, may frictionally fit to the base 210, may be welded or glued to the base 210 or may be snapped onto the base 210. In various embodiments, the base 210 may include features which assist with the connection of the cap 280 to the base 210, such as corresponding lugs, screw channels, or other features needed to secure the cap 280 to the base 210.

Figure 7:
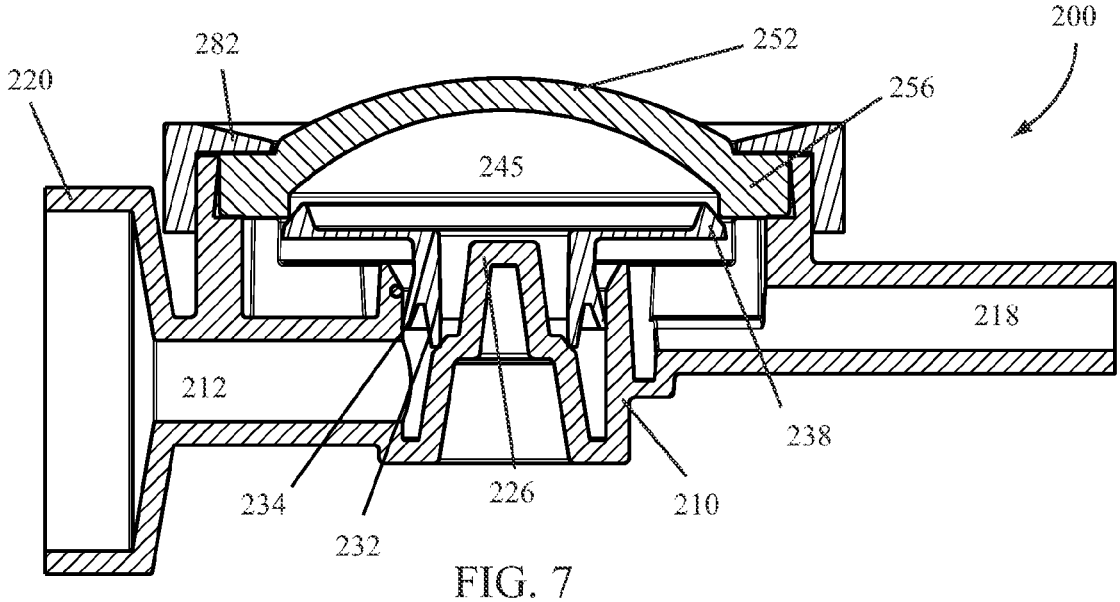
FIG. 7 illustrates a cross-sectional view of a pump according to various embodiments of the invention.

A pump 200 according to various embodiments of the invention may include a base 210, a valve 230, a bellow 250 and a cap 280 fitted together as illustrated in FIG. 7. The valve 230 may fit within the interior chamber 214 of the base 210 such that an inner portion of the valve walls 232 rest on or come into contact with the spacer 226. A portion of the valve flange 234 may also contact a portion of the base 210. The contact between the valve flange 234 and the base 210 may close off the inlet passage 212 from a pump chamber 245 formed from a portion of the interior chamber 214 of the base and the bellow chamber 258. The bellow 250 may rest on or contact the base rim 222 as illustrated in FIG. 7. In other embodiments, the bellow 250 may be supported on or within the base 210 using any desired means. A portion of the bellow rim 256 may contact the valve rim 238. A pump chamber 245 is defined within the space formed by the base 210, the valve chamber 240 and the bellow chamber 258. As illustrated in FIG. 7, the pump chamber 245 is a closed volume when in rest. A cap 280 or other securing mechanism fitted over a portion of the bellow 250 and the base 210 may hold the pump 200 together. For example, as illustrated in FIG. 7, the cap 280 may fit over the base 210 and the cap flange 282 may extend over the bellow 250 which rests on the base rim 222. The cap 280 may be secured to the base 210 and the cap flange 282 may hold the bellow 250 and the valve 230 in a desired position for the pump 200.

Figure 8:
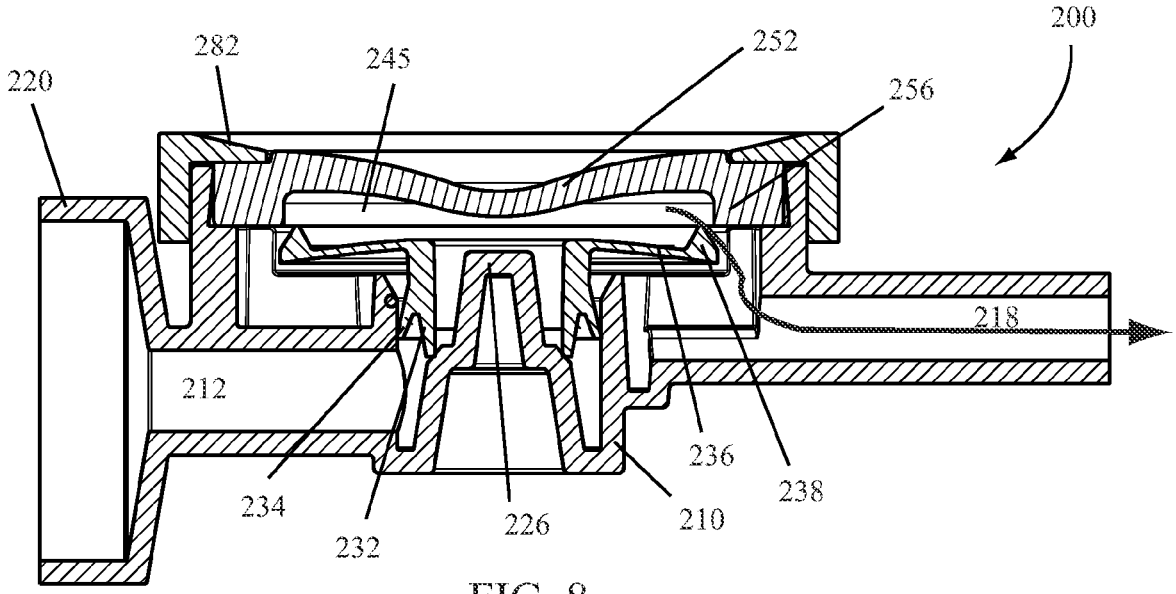
FIG. 8 illustrates a cross-sectional view of a pump according to various embodiments of the invention.
Figure 9:
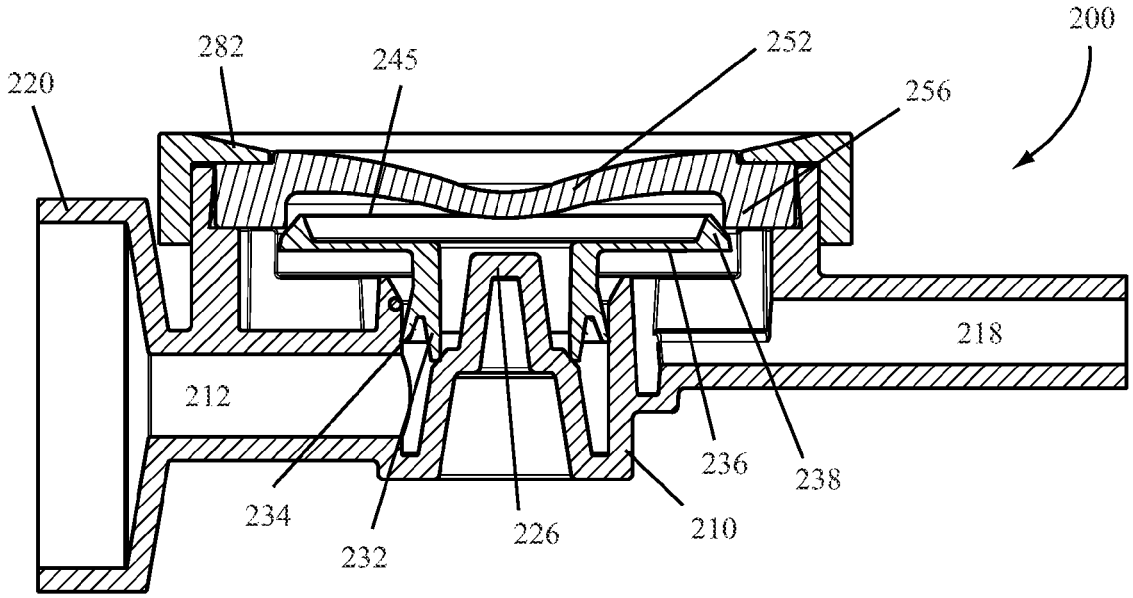
FIG. 9 illustrates a cross-sectional view of a pump according to various embodiments of the invention.
Figure 10:
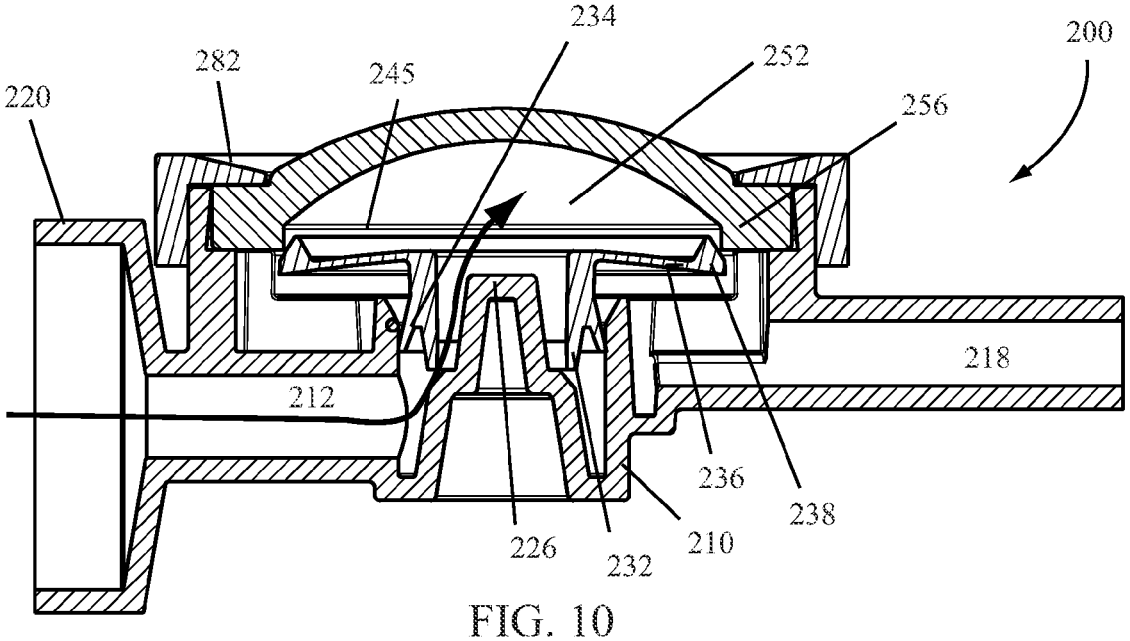
FIG. 10 illustrates a cross-sectional view of a pump according to various embodiments of the invention.

FIGS. 8 through 10 illustrate a pump 200 according to embodiments of the invention in operation. As illustrated in FIG. 8, a force may be applied to the bellow dome 252, thereby altering the volume and shape of the pump chamber 245. When such a force is applied to the bellow dome 252, a product stored in the pump chamber 245 applies a force to the valve 230 and particularly to the valve disc 236. As a result, the valve disc 236 may flex which may break the contact between the valve rim 238 and the bellow rim 256. If sufficient force is applied to the bellow dome 252 to break the contact between the valve rim 238 and the bellow rim 256 as illustrated in FIG. 8, product within the pump chamber 245 may escape from the pump chamber 245 and flow through the opening between the valve rim 238 and the bellow rim 256. For example, product may flow out of the pump chamber 245 in the direction of the arrow in FIG. 8 such that product escapes or exists the pump 200 through the discharge passage 218.

According to some embodiments of the invention, when a force is applied to the bellow dome 252 as illustrated in FIG. 8, a valve flange 234 in contact with a portion of the base 210 may help to maintain the contact between the valve walls 232 and the spacer 226 which may prevent a backflow of product through the valve walls 232 into the inlet passage 212.

FIG. 9 illustrates a pump 200 after the force being applied in FIG. 8 is released or after sufficient product has exited the pump chamber 245 such that a force is no longer applied to the valve disc 236. As illustrated, once the force within the valve chamber 245 is below the force required to flex the valve disc 236, the valve disc 236 may return to a position wherein the valve disc 236 is in contact with the bellow rim 256. In addition, the valve walls 232 maintain contact with the spacer 226. Thus, the pump chamber 245 is again sealed or closed.

Following the release of the force on the bellow dome 252, the bellow dome 252 may return to its original form or shape as illustrated in FIG. 10. As the bellow dome 252 retracts or moves back into its original position or shape, a vacuum may be formed within the pump chamber 245. The vacuum may act on the valve 230 such that the valve walls 232 are pulled away from contact with the spacer 226 as illustrated in FIG. 10. Once the valve walls 232 are separated from contact with the spacer 226, the vacuum in the pump chamber 245 may pull product from the inlet passage 212 into the pump chamber 245. In this manner, the pump chamber 245 may refill with product. When the bellow dome 252 has returned to its original shape or position, or when the vacuum force is insufficient to raise the valve 230, the valve walls 232 may again contact the spacer 226. This contact may stop the flow of product from the inlet passage 212 into the valve chamber 245 and the pump 200 may be back in the position illustrated in FIG. 7.

As illustrated in FIGS. 7 through 10, a product may be pumped through the pump 200 by actuating the bellow dome 252 of the pump 200. When actuated, product in the pump chamber 245 may be forced out of the pump chamber 245 and through the discharge passage 218. In some instances, the product may follow the path illustrated in FIG. 8. Upon reducing or ceasing actuation of the bellow dome 252, the bellow dome 252 may return to its original position, drawing product from a container attached to the pump 200 through the inlet passage 212 and into the pump chamber 245. For example, product may enter the pump chamber 245 along the path illustrated in FIG. 10. In this manner, a pump 200 may be actuated to dispense a product from a container attached to the pump 200.

According to still other embodiments of the invention, a pump 300 may include various components as illustrated in FIGS. 11A through 11D.

Figure 11A:
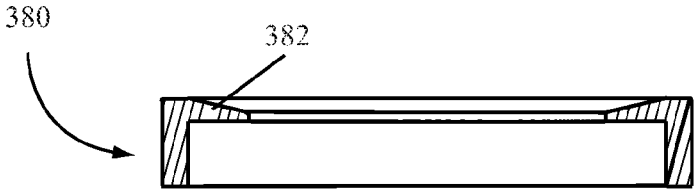
FIGS. 11A through 11D illustrate cross-sectional views of various components of a pump according to various embodiments of the invention.
Figure 11B:
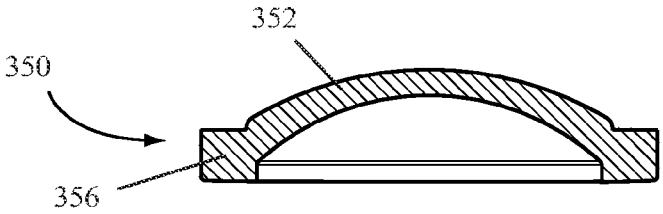
Figure 11C:
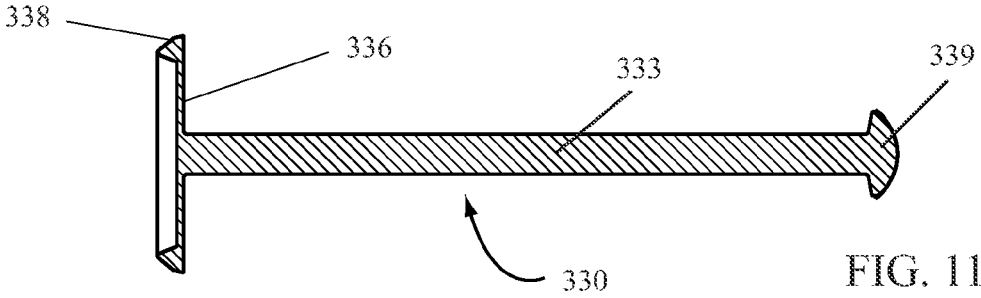
Figure 11D:
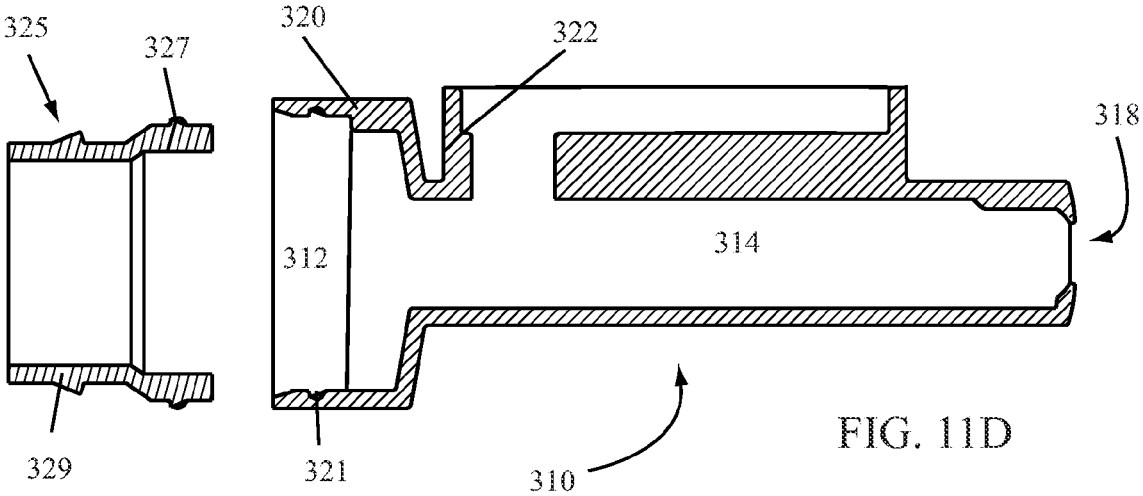

A pump 300 base 310 according to various embodiments of the invention is illustrated in FIG. 11D. The base 310 may include a container attachment 320, an inlet passage 312, an interior chamber 314, a base rim 322 and a discharge passage 318. The container attachment 320 may include any desired attachment device for attaching the base 310 or the pump 300 to a container such as a bottle, tube, bag, or pouch. In some embodiments of the invention, the container attachment 320 may also contain an attachment feature 321 for mating with or attaching to an attachment adapter 325. An attachment adapter 325 may include an adapter attachment feature 327 configured to mate with or otherwise attach to the attachment feature 321. An attachment adapter 325 may also include one or more connecter flanges 329. A connecter flange 329 may be used to attach to a container or to hold a container onto the attachment adapter 325 for assembly or mating to a pump 300. An adapter attachment 325 may also contact other parts of a pump 300 and may assist in assembling a pump 300.

An inlet passage 312 may allow a product to flow from a container into a portion of the interior chamber 314 of the base 310. The interior chamber 314 may include a hollow passage into which a valve 330 may fit or be seated. The shape, size, dimensions, and other features of the interior passage 345 may be altered or modified as desired. The base 310 or a portion of the interior chamber 345 may also include a base rim 322. The discharge passage 318 may be positioned opposite the inlet passage 312 or on the opposite side of the interior chamber 345 from the inlet passage 212. As illustrated in FIG. 11D, the discharge passage 318 may include an opening in the base 310.

According to various embodiments of the invention, the base 310 may be molded as a single piece or component. In other embodiments, the base 310 and the attachment adapter 325 may be molded as separate components and assembled to form a unitary piece. The base 310 and attachment adapter 325 may be molded or formed from any desirable material, including, for example, a resin material or a plastic material which may be molded using conventional molding techniques.

A valve 330 for a pump 300 according to various embodiments of the invention is illustrated in FIG. 11C. A valve 330 may include a valve stem 333, an outlet valve 339 at one end of the valve stem 333, and a valve disc 336 at an end of the valve stem 333 opposite the outlet valve 339. A valve rim 338 may circle or circumscribe a portion of the valve disc 336 or may be located anywhere desired on the valve disc 336. For example, as illustrated in FIG. 11C a valve rim 338 may be located on an outer rim of a valve disc 336.

A valve 330 according to various embodiments of the invention may be formed of any desired material. In some embodiments of the invention, the valve 330 may be a molded component. The valve 330 may be made of a flexible material or other moldable material. For example, the valve 330 may be made of silicon or a TPU material.

A bellow 350 according to embodiments of the invention is illustrated in FIG. 11B. A bellow 350 may include a bellow dome 352, a bellow chamber 358, and a bellow rim 356. The bellow chamber 358 may be defined by the shape of the bellow dome 352. Different sizes and shapes of the bellow chamber 358 may be created by altering the shape or size of the bellow dome 352.

A bellow 350 may be formed of any desired material. In some embodiments of the invention, a bellow 350 may be a material that may be deformed but which will return to its original shape after a force causing such deformation is removed. For example, the bellow 350 may be made of silicon or a TPU material. The bellow dome 352 may be deformed to change the volume or shape of the bellow chamber 358. As the bellow dome 352 is deformed, the remainder of the bellow 350 may flex or deform in a corresponding manner as desired.

A cap 380 according to various embodiments of the invention is illustrated in FIG. 11A. A cap 380 may include a cap flange 382. According to various embodiments of the invention, a cap 380 may be attachable to the base 310 or to another portion of a pump 300 to keep the various components of a pump 300 assembled. For example, the cap 380 illustrated in FIG. 11A may be positioned over a bellow 350 and a base 310 to secure the bellow 350 in an appropriate position with respect to the base 310. A cap 380 according to various embodiments of the invention may include any desired means for securing the cap 380 to the base 310 or other portion of the pump 300. For instance, the cap 380 may be screwed onto the base 310, may frictionally fit to the base 310, may be welded or glued to the base 310 or may be snapped onto the base 310. In various embodiments, the base 310 may include features which assist with the connection of the cap 380 to the base 310, such as corresponding lugs, screw channels, or other features needed to secure the cap 380 to the base 310.

Figure 12:
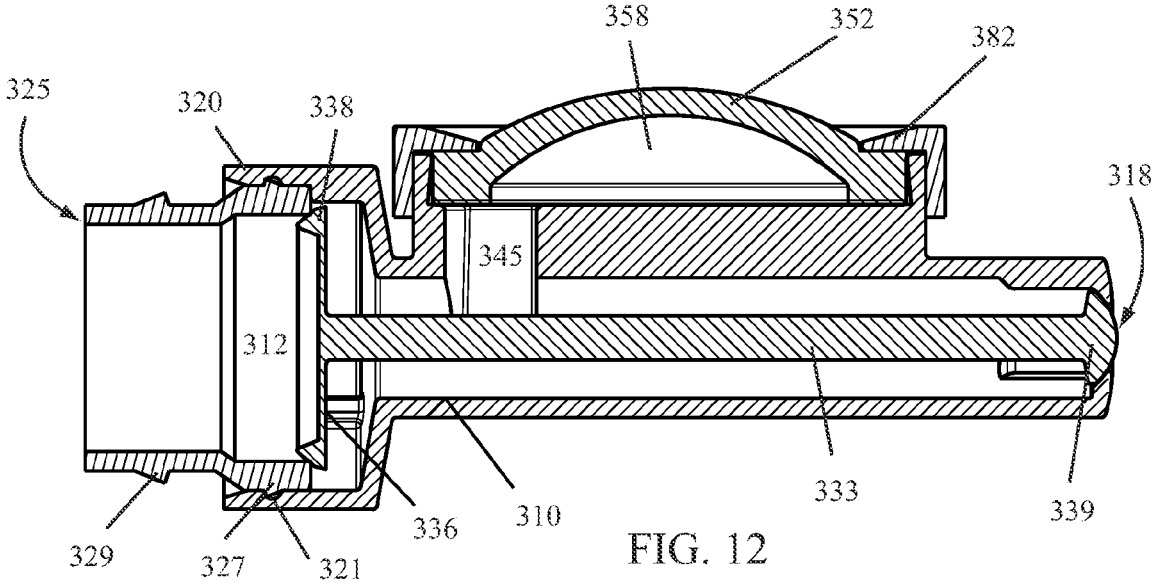
FIG. 12 illustrates a cross-sectional view of a pump according to various embodiments of the invention.

A pump 300 according to various embodiments of the invention may include a base 310, an attachment adapter 325, a valve 330, a bellow 350, and a cap 380 fitted together as illustrated in FIG. 12. According to embodiments of the invention, a valve 330 may fit within the interior chamber 314 of the base 310 such that the outlet valve 339 mates with the discharge passage 318 of the base 310. The outlet valve 339 may seal or close the discharge passage 318 when positioned in the interior chamber 314. The valve stem 333 may extend through the interior chamber 314 terminating in the valve disc 336 in the inlet passage 312. A portion of the attachment adapter 325, when assembled to the base 310, may contact a portion of the valve rim 338 of the valve disc 336 and may assist in positioning or holding the valve 330 in the base 310. As illustrated in FIG. 12, the attachment adapter 325 may be fitted to the base 310 such that the adapter attachment feature 327 fits with the attachment feature 321 of the base 310. Such attachment may secure the attachment adapter 325 to the base 310 and hold valve 330 within the interior chamber 314 of the base 310.

A bellow 350 may rest or be positioned on a portion of a base rim 322 as illustrated in FIG. 12. A bellow rim 356 may rest on a portion of the base 310 and on the base rim 322. According to embodiments of the invention, the bellow chamber 358 may be in communication with the interior chamber 314 of the base 310, thereby forming a pump chamber 345 when the bellow 350 is assembled to the base 310. A cap 380 or other securing mechanism fitted over a portion of the bellow 350 and the base 310 may hold the pump 300 together. For example, as illustrated in FIG. 12, the cap 380 may fit over the base 310 and the cap flange 382 may extend over a portion of the bellow rim 356. The cap 380 may be secured to the base 310 and the cap flange 382 may hold the bellow 350 in the desired position for the pump 300.

FIGS. 12 through 15 illustrate the operation of a pump 300 according to embodiments of the invention. As illustrated in FIG. 12, when the pump 300 is in a resting position, the pump chamber 345 is a closed volume defined by the bellow dome 352 and the interior chamber 314 of the base 310. The valve 330 positioned within the interior chamber 314 may seal both the inlet passage 312 and the discharge passage 318 of the pump 300.

Figure 13:
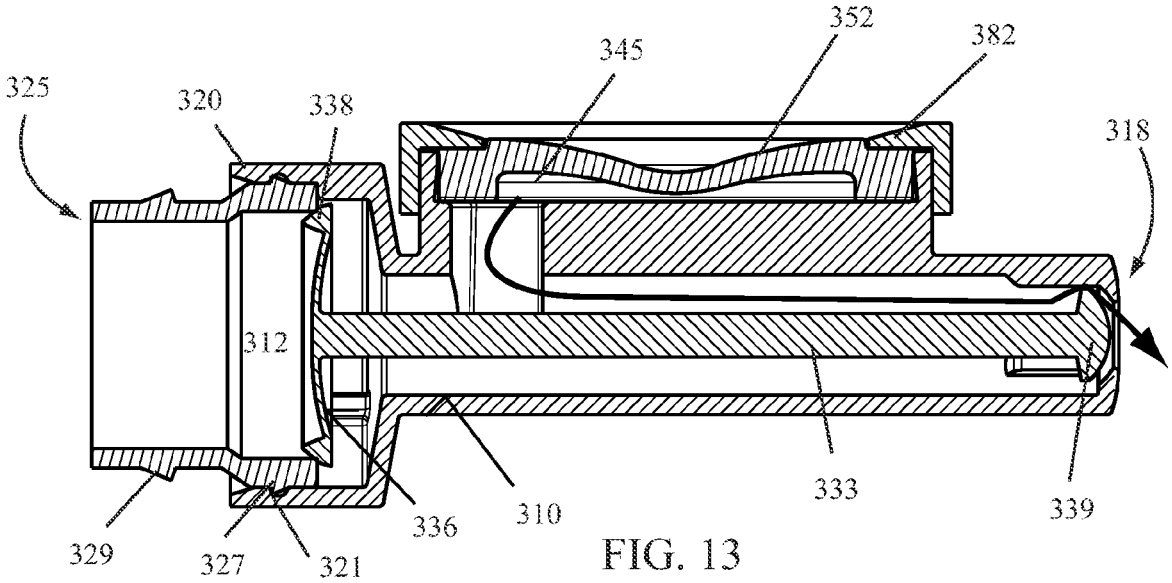
FIG. 13 illustrates a cross-sectional view of a pump according to various embodiments of the invention.

A force may be applied to the bellow dome 352 as illustrated in FIG. 13. When a force is applied to the bellow dome 352, the bellow dome 352 may be deformed as illustrated. The deformation of the bellow dome 352 alters the volume within the pump chamber 345. A product stored in the pump chamber 345 may be moved by such deformation. The valve disc 336 may be flexible such that when a force is applied to the product or the volume of the pump chamber 345 is altered, product may push on the valve disc 336 causing it to flex. Flexion of the valve disc 356 may move the valve stem 333 in the direction of the flexion and may cause the outlet valve 339 to disengage from the discharge passage 318, opening the discharge passage 318. When the discharge passage 318 is opened, product from within the pump chamber 345 may exit the pump 300 in the direction indicated by the arrow in FIG. 13.

Figure 14:
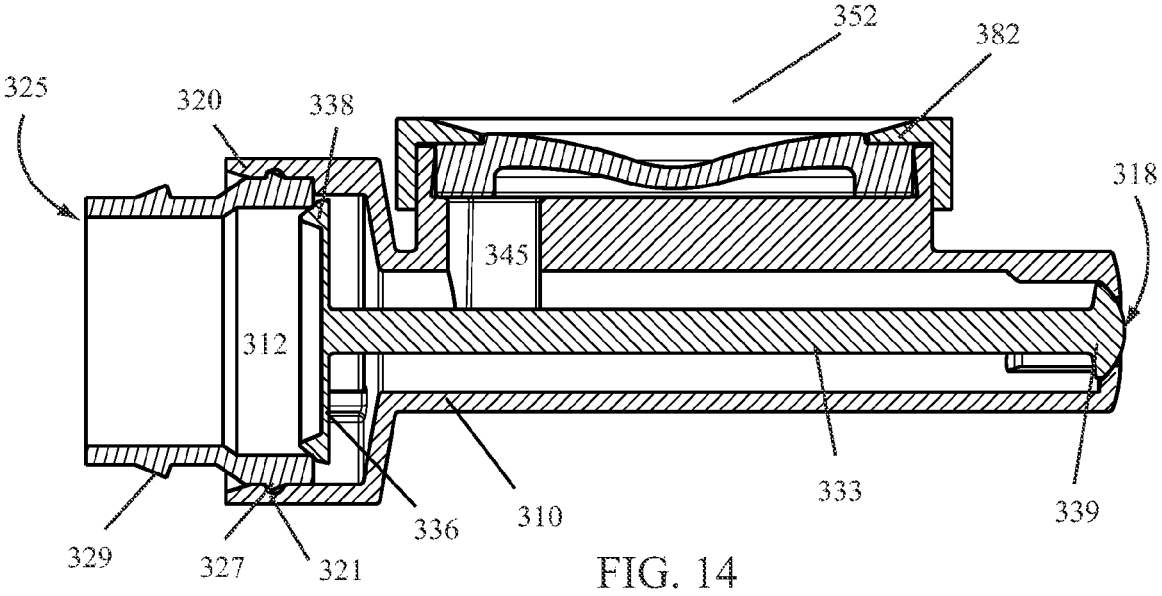
FIG. 14 illustrates a cross-sectional view of a pump according to various embodiments of the invention.

As illustrated in FIG. 14, when a force is removed from the bellow dome 352 or sufficient product in the pump chamber 345 has escaped the pump chamber 345, the valve disc 356 may return to its original position. Movement of the valve disc 356 to an original position may return the valve stem 333 to an original position which may close the outlet valve 339 and discharge passage 318.

Figure 15:
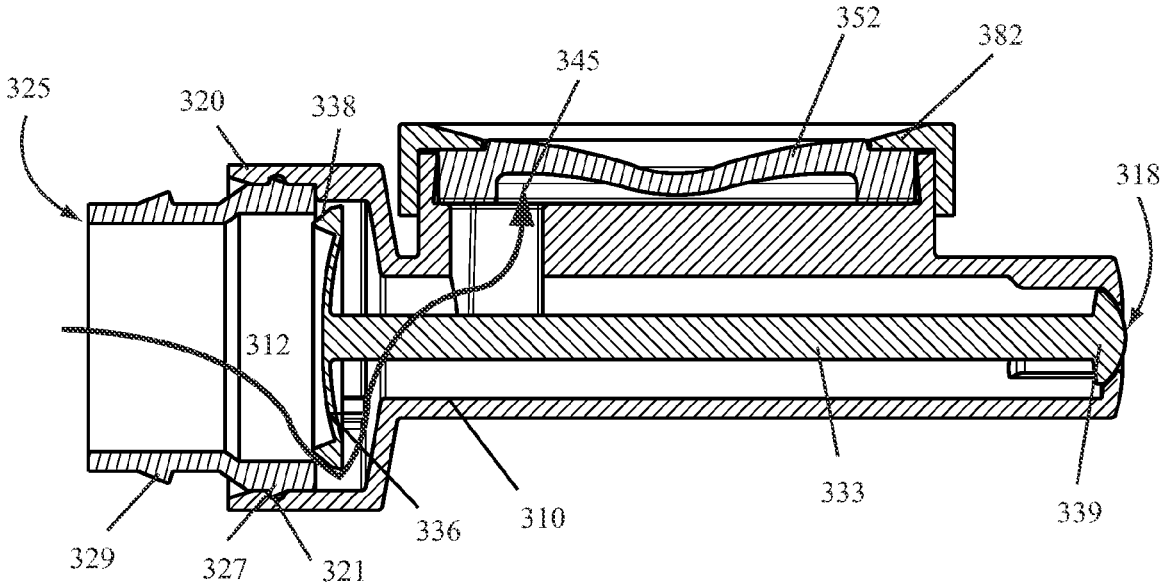
FIG. 15 illustrates a cross-sectional view of a pump according to various embodiments of the invention.

Following the release of the force on the bellow dome 352, the bellow dome 352 may begin to return to its original form or shape as illustrated in FIG. 15. As the bellow dome 352 retracts or moves back into its original position or shape, a vacuum may be formed within the pump chamber 345. The vacuum may act on the valve 330 such that the valve disc 356 flexes away from the inlet passage 312 and such that at least a portion of the contact between the valve rim 338 and the attachment adapter 325 is broken. Once the valve rim 338 is separated from contact with the attachment adapter 325, product from a container may flow through the inlet passage 312, past the valve rim 338 and valve disc 336 and into the pump chamber 345. In this manner, the pump chamber 345 may refill with product from the container. For example, product may flow from a container through the inlet passage 312 and into the pump chamber 345 along the path illustrated by the arrow in FIG. 15.

When the bellow dome 352 returns to its original shape or position, or when the vacuum force is insufficient to flex the valve disc 336, the valve rim 338 may again contact the attachment adapter 325 and form a seal between the valve 330 and the attachment adapter 325 as illustrated in FIG. 12.

As illustrated in FIGS. 12 through 15, a product may be pumped through the pump 300 by actuating the bellow dome 352 of the pump 300. When actuated, product in the pump chamber 345 may be forced out of the pump chamber 345 and through the discharge passage 318. In some instances, the product may follow the path illustrated in FIG. 13. Upon reducing or ceasing actuation of the bellow dome 352, the bellow dome 352 may return to its original position, drawing product from a container attached to the pump 300 through the inlet passage 312 and into the pump chamber 345. For example, product may enter the pump chamber 345 along the path illustrated in FIG. 15. In this manner, a pump 300 may be actuated to dispense a product from a container attached to the pump 300.

The pumps according to various embodiments of the invention have been described as being made of certain materials. It is understood that other materials may be substituted or interchanged with various embodiments of the invention to provide pumps having different material characteristics as desired.

Further, the pumps according to various embodiments of the invention may be attached to or otherwise in communication with a container. It is understood that a container may include any receptacle which may be used to hold a product, including, but not limited to, bottles, bags, airless systems, tubes and other devices.

While various embodiments of the invention have been described with respect to pumps or pump devices used in the personal and beauty care markets, it is understood that the pumps of various embodiments of the invention may be used in other fields and/or markets and that such pumps may be scaled up or down as desired to meet the requirements of any desired pump specifications.

Having thus described certain particular embodiments of the invention, it is understood that the invention defined by the appended claims is not to be limited by particular details set forth in the above description, as many apparent variations thereof are contemplated. Rather, the invention is limited only be the appended claims, which include within their scope all equivalent devices or methods which operate according to the principles of the invention as described.

What is claimed is:

1. A pump, comprising:

a base comprising:

a container attachment comprising an attachment feature;

an interior chamber; and a discharge passage;

a valve positioned in at least a portion of the interior chamber, the valve comprising:

an outlet valve in sealing communication with the discharge passage;

a valve disc;

a valve stem positioned between and in communication with the valve disc on one end thereof and the outlet valve on an opposite end thereof; and at least one valve rim positioned on the valve disc;

an attachment adapter comprising an adapter attachment feature, wherein the adapter attachment feature is connected to the attachment feature of the container attachment, wherein at least a portion of the at least one valve rim contacts the attachment adapter; and a bellow in communication with the base, wherein the bellow and the interior chamber define a pump chamber.

2. The pump of claim 1, wherein the bellow comprises a material selected from the group consisting of silicon and TPU.

3. The pump of claim 1, wherein the valve comprises a material selected from the group consisting of silicon and TPU.

4. The pump of claim 1, wherein the base comprises a unitary component.

5. The pump of claim 1, further comprising a cap attached to the base and securing the bellow between the base and at least a portion of the cap.

6. The pump of claim 1, further comprising a product in the pump chamber, wherein application of a force to the bellow flexes the valve disc and disengages the outlet valve from the discharge passage.

7. The pump of claim 6, wherein release of the force on the bellow flexes the at least one valve rim away from contact with the attachment adapter, allowing product to flow into the pump chamber.

8. The pump of claim 1, further comprising a container attached to the attachment adapter, the container selected from the group consisting of bottle, tube, bag, and pouch.

9. A pump, comprising:

a unitary molded base component comprising:

a container attachment;

an inlet passage;

an interior chamber;

a base rim; and a discharge passage opening at an end of the singular base component opposite the inlet passage;

an attachment adapter connected to at least a portion of the container attachment;

a bellow in communication with the unitary molded base component, wherein the bellow and the interior chamber define a pump chamber;

a cap attached to at least a portion of the unitary molded base component and securing the bellow between the cap and the unitary molded base component;

a valve positioned in at least a portion of the interior chamber between the container attachment and the discharge passage opening, the valve comprising:

an outlet valve in sealing communication with the discharge passage opening;

a valve disc;

at least one valve rim positioned on the valve disc and in sealing communication with the attachment adapter;

a valve stem positioned between and in communication with the valve disc and the outlet valve; and a product in the pump chamber, wherein application of a force to the bellow flexes the valve disc and disengages the outlet valve from the discharge passage opening and wherein release of the force disengages the at least one valve rim from the attachment adapter allowing product to flow into the pump chamber.

10. A pump, comprising:

a single molded base component comprising:

a container attachment;

an interior chamber; and a discharge passage;

a valve positioned in at least a portion of the interior chamber, the valve comprising:

an outlet valve in sealing communication with the discharge passage;

a valve disc;

a valve stem positioned between and in communication with the valve disc on one end thereof and the outlet valve on an opposite end thereof; and at least one valve rim positioned on the valve disc;

an attachment adapter connected to at least a portion of the container attachment, wherein at least a portion of the at least one valve rim contacts the attachment adapter; and a bellow in communication with the single molded base component, wherein the bellow and the interior chamber define a pump chamber.

* * * * *